US008033628B2

(12) United States Patent
Shi et al.

(10) Patent No.: US 8,033,628 B2
(45) Date of Patent: Oct. 11, 2011

(54) SIGNAL PROCESSING OF INDICIA FOR MEDIA IDENTIFICATION

(75) Inventors: Yang Shi, San Diego, CA (US); Greg M. Burke, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 856 days.

(21) Appl. No.: 12/047,359

(22) Filed: Mar. 13, 2008

(65) Prior Publication Data

US 2009/0231403 A1 Sep. 17, 2009

(51) Int. Cl.
*B41J 29/38* (2006.01)

(52) U.S. Cl. ..... 347/14

(58) Field of Classification Search ..... 347/14
See application file for complete search history.

(56) References Cited

U.S. PATENT DOCUMENTS 7,120,272 B2 * 10/2006 Guiguizian ..... 382/100
2006/0103691 A1 5/2006 Dietl et al.

* cited by examiner

*Primary Examiner* — Uyen Chau N Le
*Assistant Examiner* — Hoang Tran
(74) *Attorney, Agent, or Firm* — William R. Zimmerli; David A. Novais; Eugene I. Shkurko

(57) ABSTRACT

A method of identifying a type of recording medium includes moving the recording medium relative to a sensor at a substantially uniform speed; processing a signal from the sensor to provide digitized data of the signal; identifying a plurality of peaks in the digitized data; determining at least one of the heights and widths of each of the plurality of peaks; determining a peak to peak distance between two adjacent peaks of the plurality of peaks; determining the position of a peak corresponding to the reference mark using a combination of parameters related to at least two of the peak heights, the peak widths, and the peak to peak distance; determining a configuration of a peak corresponding to the identification mark by locating a peak that is spaced apart from the position of the peak corresponding to the reference mark; and identifying the type of recording medium using the configuration of the peak corresponding to the identification mark.

10 Claims, 13 Drawing Sheets

SIGNAL PROCESSING OF INDICIA FOR MEDIA IDENTIFICATION

FIELD OF THE INVENTION

The present invention relates generally to the field of printers, and in particular to a method for identifying a type of recording medium that has been loaded into a printer.

BACKGROUND OF THE INVENTION

In a carriage printer, such as an inkjet carriage printer, a printhead is mounted in a carriage that is moved back and forth across the region of printing. To print an image on a sheet of paper or other recording medium (sometimes generically referred to as paper herein), the recording medium is advanced a given distance along a recording medium advance direction and then stopped. While the recording medium is stopped and supported on a platen, the printhead carriage is moved in a direction that is substantially perpendicular to the recording medium advance direction as marks are controllably made by marking elements on the recording medium—for example by ejecting drops from an inkjet printhead. After the carriage has printed a swath of the image while traversing the recording medium, the recording medium is advanced, the carriage direction of motion is reversed, and the image is formed swath by swath.

In order to produce high quality images, it is helpful to provide information to the printer controller electronics regarding the printing side of the recording medium, which can include whether it is a glossy or matte-finish paper. It is well-known to provide identifying marks or indicia, such as a bar-code, on a non-printing side of the recording medium to distinguish different types of recording media. It is also well known to use a sensor in the printer to scan the indicia and thereby identify the recording medium and provide that information to the printer control electronics. U.S. Pat. No. 7,120,272, for example includes a sensor that makes sequential spatial measurements of a moving media that contains repeated indicia to determine a repeat frequency and repeat distance of the indicia. The repeat distance is then compared against known values to determine the type of media present.

For some applications, factors that can make it more difficult to reliably identify media type on the basis of sensed indicia include the random cutting position of the media, media slip during media advance in the printer, media advance motor control error, skew of the media, and the presence of a logo, indicating (for example) the manufacturer of the media. Incorrect identification of media type typically causes image quality degradation, because the printing conditions that are appropriate for the type of media that was mistakenly identified may be inappropriate for the actual type of media in the printer. What is needed, therefore, is a method having improved reliability for identifying media type on the basis of marks or indicia that have previously been provided on a surface of the recording medium.

SUMMARY OF THE INVENTION

According to an aspect of the present invention, a method of identifying a type of recording medium is provided. The recording medium comprises information marks including a reference mark and an identification mark. A relationship of the identification mark and the reference mark is indicative of the type of recording medium. The method includes moving the recording medium relative to a sensor at a substantially uniform speed; processing a signal from the sensor to provide digitized data of the signal; identifying a plurality of peaks in the digitized data; determining at least one of the heights and widths of each of the plurality of peaks; determining a peak to peak distance between two adjacent peaks of the plurality of peaks; determining the position of a peak corresponding to the reference mark using a combination of parameters related to at least two of the peak heights, the peak widths, and the peak to peak distance; determining a configuration of a peak corresponding to the identification mark by locating a peak that is spaced apart from the position of the peak corresponding to the reference mark; and identifying the type of recording medium using the configuration of the peak corresponding to the identification mark.

BRIEF DESCRIPTION OF THE DRAWINGS

In the detailed description of the example embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Although the examples described herein refer to inkjet carriage printer systems, other types of printing systems can also benefit from the advantages of reliable media identification as provided by this invention. Such printing systems may include a variety of inkjet printing systems including page-width drop on demand printers, carriage drop on demand printers, and continuous inkjet printers, as well as other types of printing technologies such as dye sublimation printing systems, for example.

Figure 1:
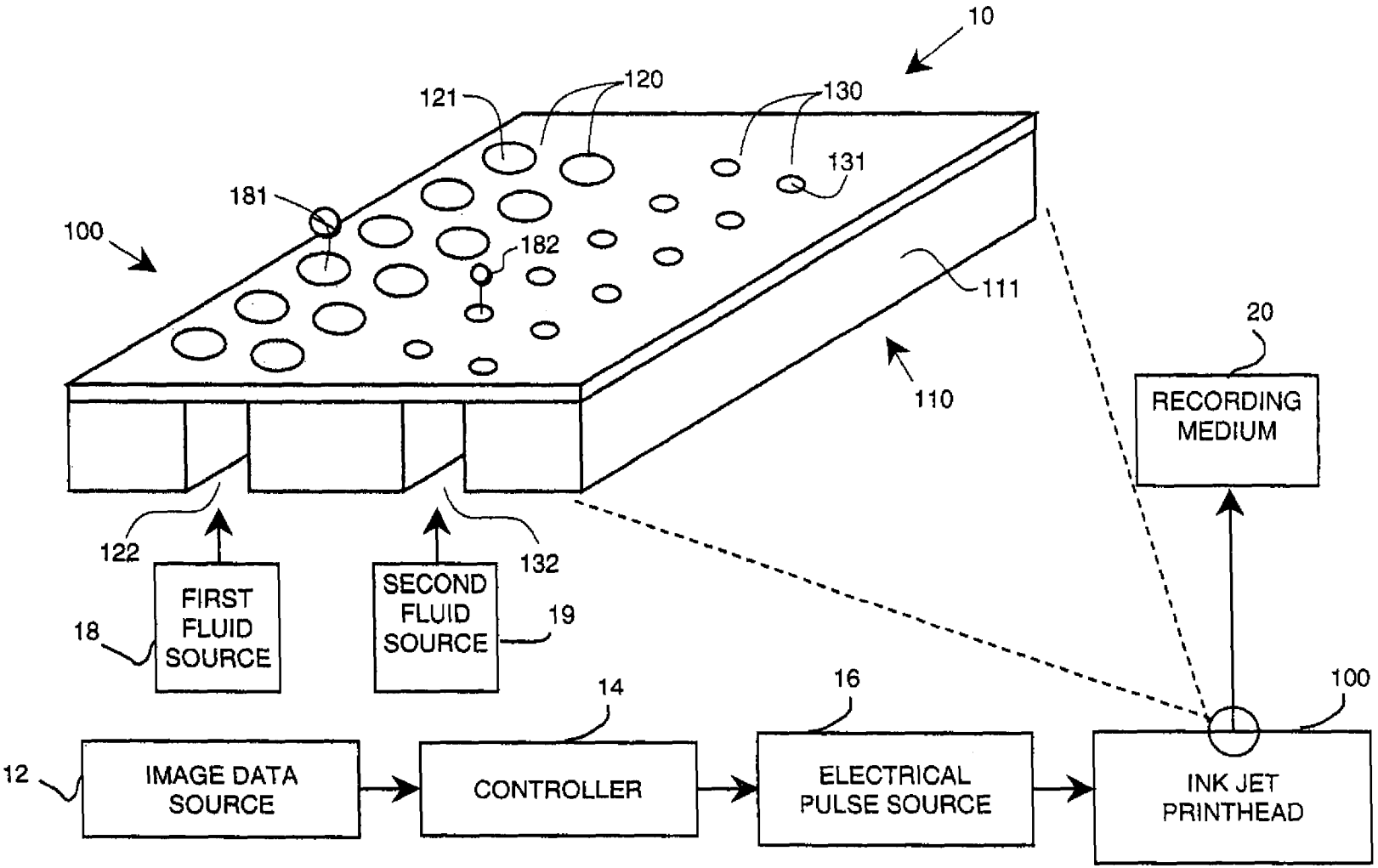
FIG. 1 is a schematic representation of an inkjet printer system.

Referring to FIG. 1, a schematic representation of an inkjet printer system 10 is shown, as described in US 2006/0103691 A1. The system includes a source 12 of image data which provides signals that are interpreted by a controller 14 as being commands to eject drops. Controller 14 outputs signals to a source 16 of electrical energy pulses that are inputted to the inkjet printhead 100 which includes at least one printhead die 110. In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch. If pixels on the recording medium were sequentially numbered along the paper advance direction, the nozzles from one row of an array would print the odd numbered pixels, while the nozzles from the other row of the array would print the even numbered pixels. In fluid communication with each nozzle array is a corresponding ink delivery pathway. Ink delivery pathway 122 is in fluid communication with nozzle array 120, and ink delivery pathway 132 is in fluid communication with nozzle array 130. Portions of fluid delivery pathways 122 and 132 are shown in FIG. 1 as openings through printhead die substrate 111. One or more printhead die 110 will be included in inkjet printhead 100, but only one printhead die 110 is shown in FIG. 1. The printhead die are arranged on a support member as discussed below relative to FIG. 2. In FIG. 1, first ink source 18 supplies ink to first nozzle array 120 via ink delivery pathway 122, and second ink source 19 supplies ink to second nozzle array 130 via ink delivery pathway 132. Although distinct ink sources 18 and 19 are shown, in some applications it may be beneficial to have a single ink source supplying ink to nozzle arrays 120 and 130 via ink delivery pathways 122 and 132 respectively. Also, in some embodiments, fewer than two or more than two nozzle arrays may be included on printhead die 110. In some embodiments, all nozzles on a printhead die 110 may be the same size, rather than having multiple sized nozzles on a printhead die.

Not shown in FIG. 1 are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bilayer element) and thereby cause ejection. In any case, electrical pulses from pulse source 16 are sent to the various drop ejectors according to the desired deposition pattern. In the example of FIG. 1, droplets 181 ejected from nozzle array 120 are larger than droplets 182 ejected from nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
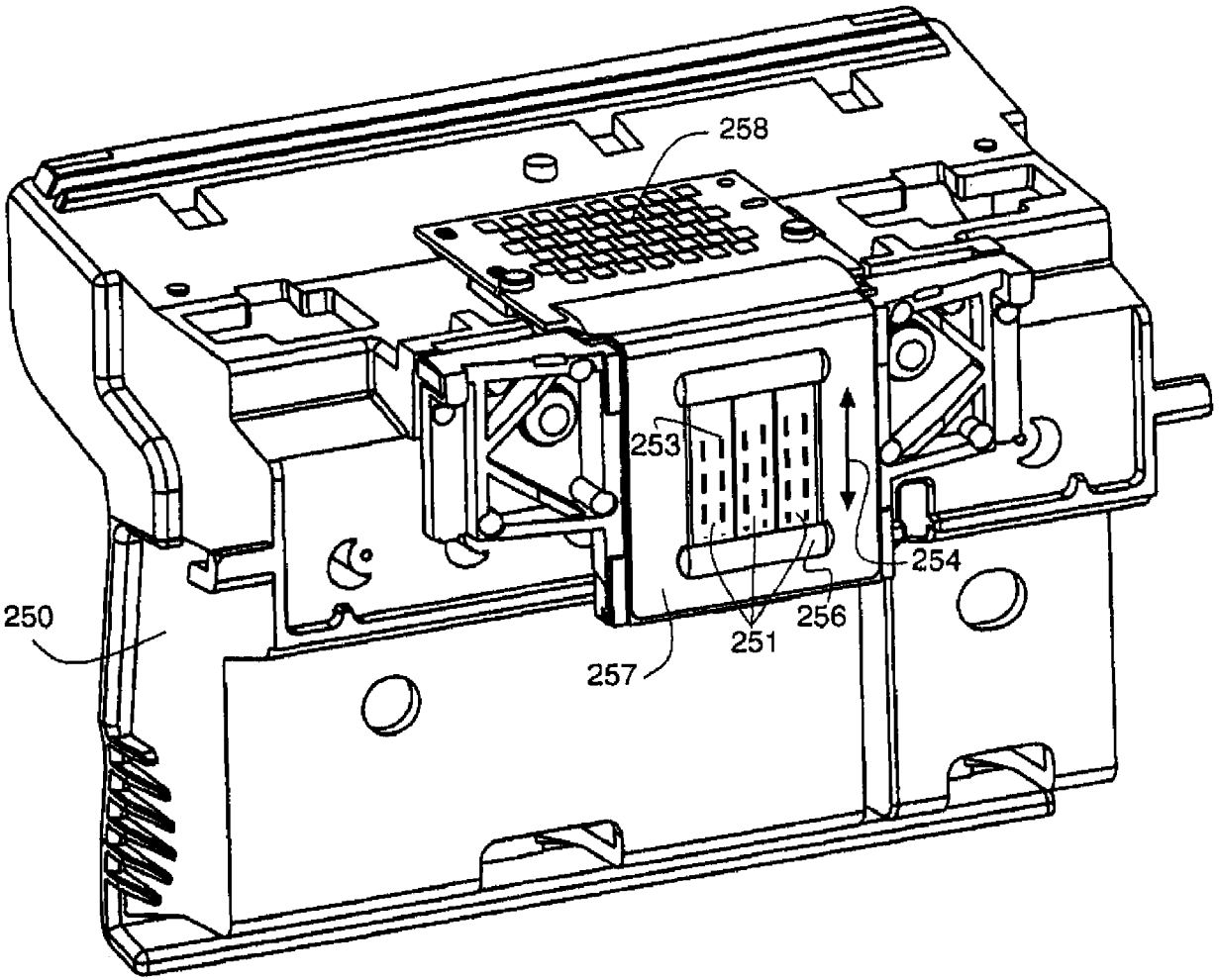
FIG. 2 is a perspective view of a portion of a printhead chassis.

FIG. 2 shows a perspective view of a portion of a printhead chassis 250, which is an example of an inkjet printhead 100. Printhead chassis 250 includes three printhead die 251 (similar to printhead die 110), each printhead die containing two nozzle arrays 253, so that printhead chassis 250 contains six nozzle arrays 253 altogether. The six nozzle arrays 253 in this example may be each connected to separate ink sources (not shown in FIG. 2), such as cyan, magenta, yellow, text black, photo black, and a colorless protective printing fluid. Each of the six nozzle arrays 253 is disposed along direction 254, and the length of each nozzle array along direction 254 is typically on the order of 1 inch or less. Typical lengths of recording media are 6 inches for photographic prints (4 inches by 6 inches), or 11 inches for 8.5 by 11 inch paper. Thus, in order to print the full image, a number of swaths are successively printed while moving printhead chassis 250 across the recording medium. Following the printing of a swath, the recording medium is advanced.

Also shown in FIG. 2 is a flex circuit 257 to which the printhead die 251 are electrically interconnected, for example by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals may be transmitted to the printhead die 251.

Figure 3:
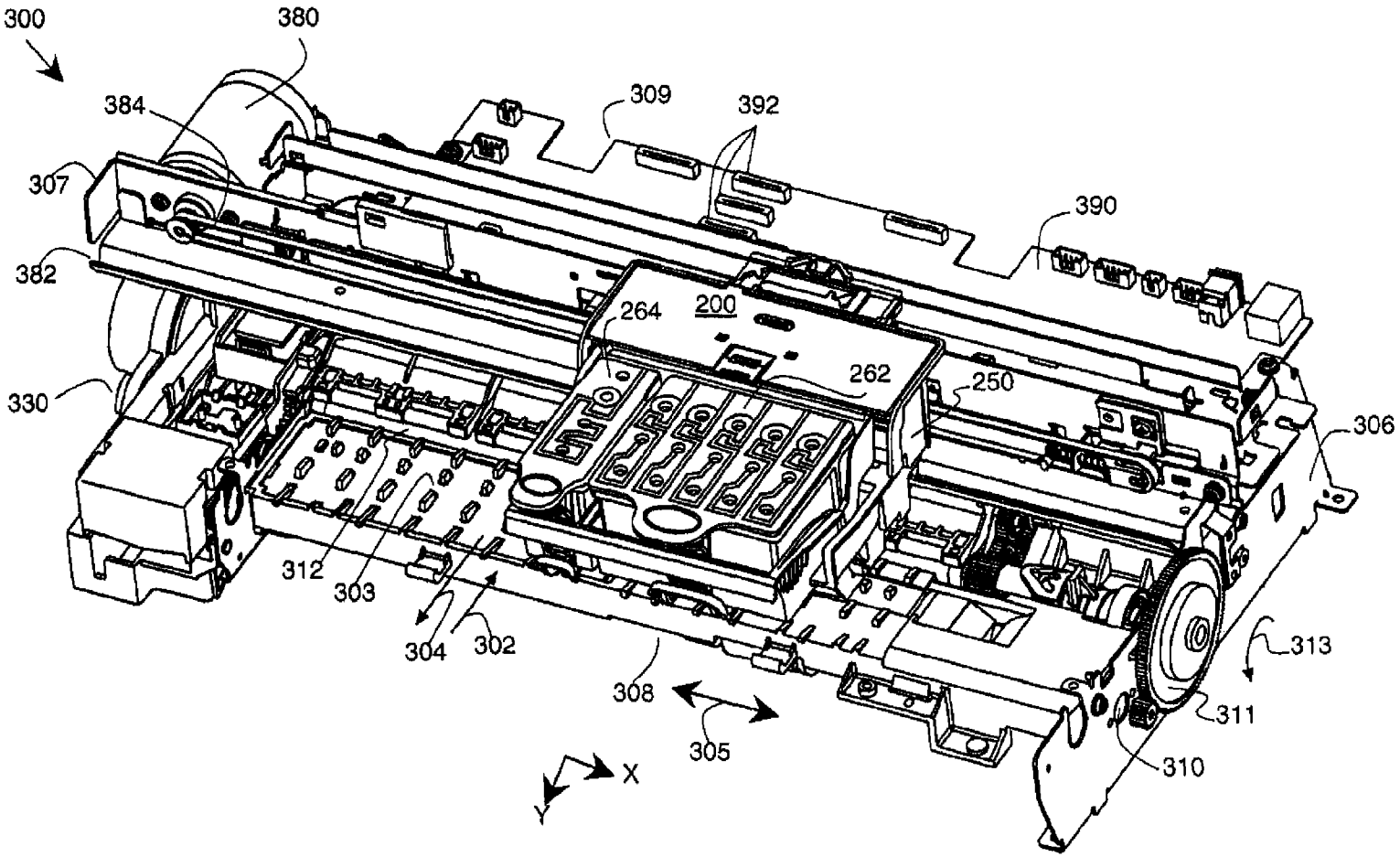
FIG. 3 is a perspective view of a portion of a carriage printer.

FIG. 3 shows a portion of a carriage printer. Some of the parts of the printer have been hidden in the view shown in FIG. 3 so that other parts may be more clearly seen. Printer chassis 300 has a print region 303 across which carriage 200 is moved back and forth 305 along the X axis between the right side 306 and the left side 307 of printer chassis 300 while printing. Carriage motor 380 moves belt 384 to move carriage 200 back and forth along carriage guide rail 382. Printhead chassis 250 is mounted in carriage 200, and ink supplies 262 and 264 are mounted in the printhead chassis 250. The mounting orientation of printhead chassis 250 is rotated relative to the view in FIG. 2, so that the printhead die 251 are located at the bottom side of printhead chassis 250, the droplets of ink being ejected downward onto the recording media in print region 303 in the view of FIG. 3. Ink supply 262, in this example, contains five ink sources cyan, magenta, yellow, photo black, and colorless protective fluid, while ink supply 264 contains the ink source for text black. Paper, or other recording media (sometimes generically referred to as paper herein) is loaded along paper load entry direction 302 toward the front 308 of printer chassis 300. A variety of rollers are used to advance the medium through the printer, as shown schematically in the side view of FIG. 4. In this example, a pickup roller 320 moves the top sheet 371 of a stack 370 of paper or other recording media in the direction of arrow 302. A turn roller 322 toward the rear 309 of the printer chassis 300 acts to move the paper around a C-shaped path (in cooperation with a curved rear wall surface) so that the paper continues to advance along direction arrow 304 from the rear 309 of the printer. The paper is then moved by feed roller 312 and idler roller(s) 323 to advance along the Y axis across print region 303, and from there to a discharge roller 324 and star wheel(s) 325 so that printed paper exits along direction 304. Feed roller 312 includes a feed roller shaft 319 along its axis, and feed roller gear 311 is mounted on the feed roller shaft 319. Feed roller 312 may consist of a separate roller mounted on feed roller shaft 319, or may consist of a thin high friction coating on feed roller shaft 319. The motor that powers the paper advance rollers is not shown in FIG. 1, but the hole 310 at the right side 306 of the printer chassis 300 is where the motor gear (not shown) protrudes through in order to engage feed roller gear 311, as well as the gear for the discharge roller (not shown). For normal paper pick-up and feeding, it is desired that all rollers rotate in forward direction 313. Toward the left side 307 in the example of FIG. 3 is the maintenance station 330. Toward the rear 309 of the printer in this example is located the electronics board 390, which contains cable connectors 392 for communicating via cables (not shown) to the printhead carriage 200 and from there to the printhead. Also on the electronics board are typically mounted motor controllers for the carriage motor 380 and for the paper advance motor, a processor and/or other control electronics for controlling the printing process, and an optional connector for a cable to a host computer.

Figure 4:
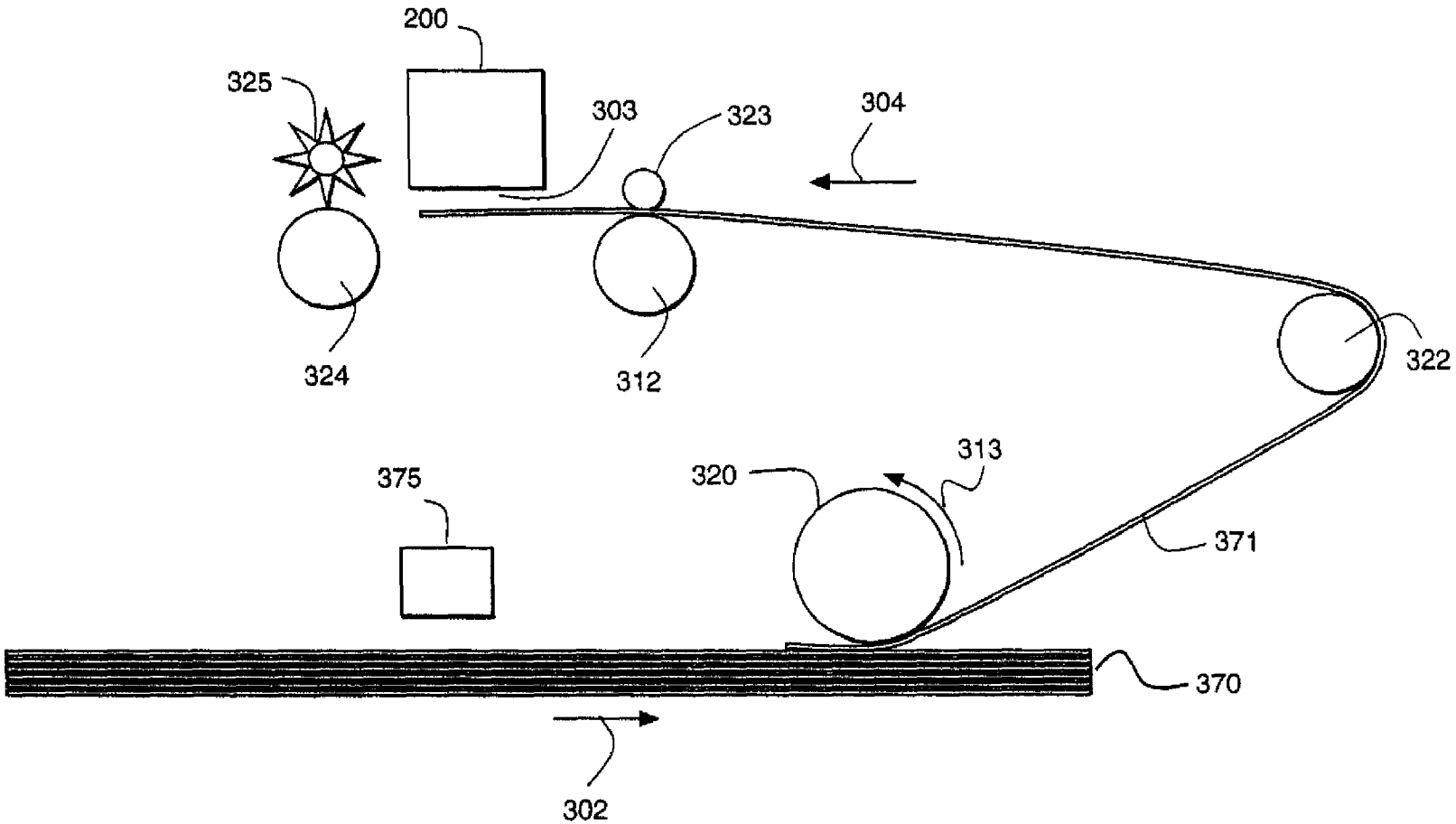
FIG. 4 is a schematic side view of a paper path in a carriage printer.
Figure 5:
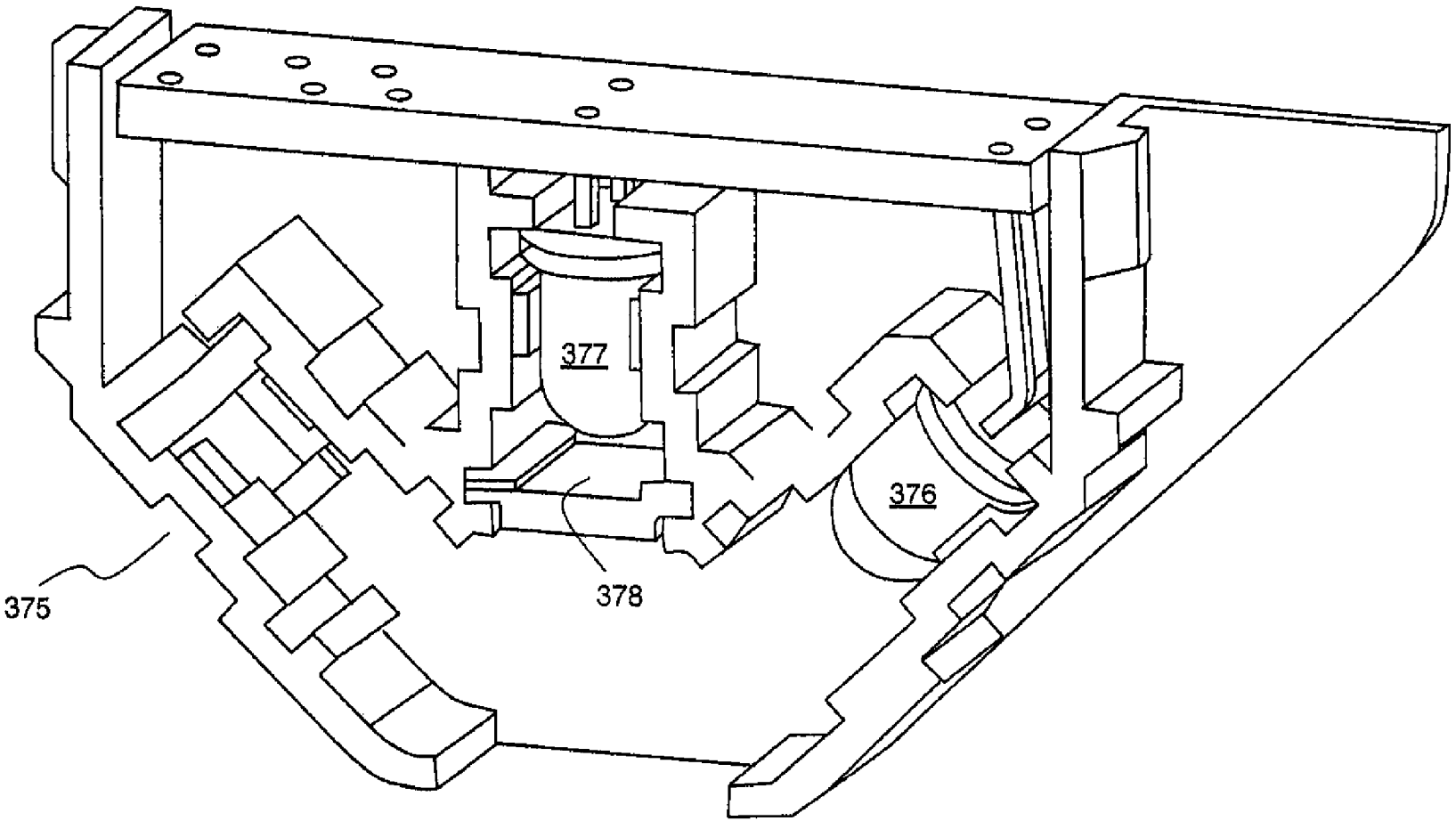
FIG. 5 is a perspective view of an embodiment of a backside media sensor.

Also shown in FIG. 4 is backside media sensor 375, which is used to detect media identification markings on the backside of the top sheet of media 371 prior to printing. The backside of the media is defined as the side of the sheet that is not intended for printing. Specialty media having glossy, luster, or matte finishes (for example) for different quality media may be marked on the backside by the media manufacturer to identify the media type. While the backside media sensor 375 is shown in FIG. 4 as being located upstream of pickup roller 320, other locations are possible. FIG. 5 shows a perspective view of a portion of the backside media sensor 375 including a light source (LED 376), photosensor 377 and aperture 378. Light emitted from the LED 376 is reflected from the backside of the top sheet 371 of media and diffuse reflections are detected by the photosensor 377 as the media moves past the sensor 375 at a substantially constant velocity v. (Although the word "light" is used herein, the term is not meant to exclude wavelengths outside the visible spectrum.) Aperture 378 allows light that is incident within a range of angles to enter the photosensor 377, thus providing a field of view of the backside of the media. The light signal reflected from the manufacturer's marking is different from the light signal on the rest of the backside of the media, so that different spacings of identification bars (for example) may be detected as different spacings of peaks or valleys of the photosensor signal. In some embodiments, fluorescent materials can be used to provide the marking information rather than light absorbing materials. In such embodiments, relative interaction between the light emitted from the LED and the markings or the rest of the backside of the media can be different. Rather than absorbing light to a greater extent than the rest of the media, the fluorescing information markings can provide greater light to the photosensor than the rest of the media. In general, the photosensor signal corresponding to the information markings is different from the photosensor signal corresponding to the rest of the backside surface of the media. While the examples described herein relate to light and photosensors, other types of physical information markings and sensors (e.g. magnetic sensors sensing marks made by magnetic materials are also contemplated).

Figure 6B:
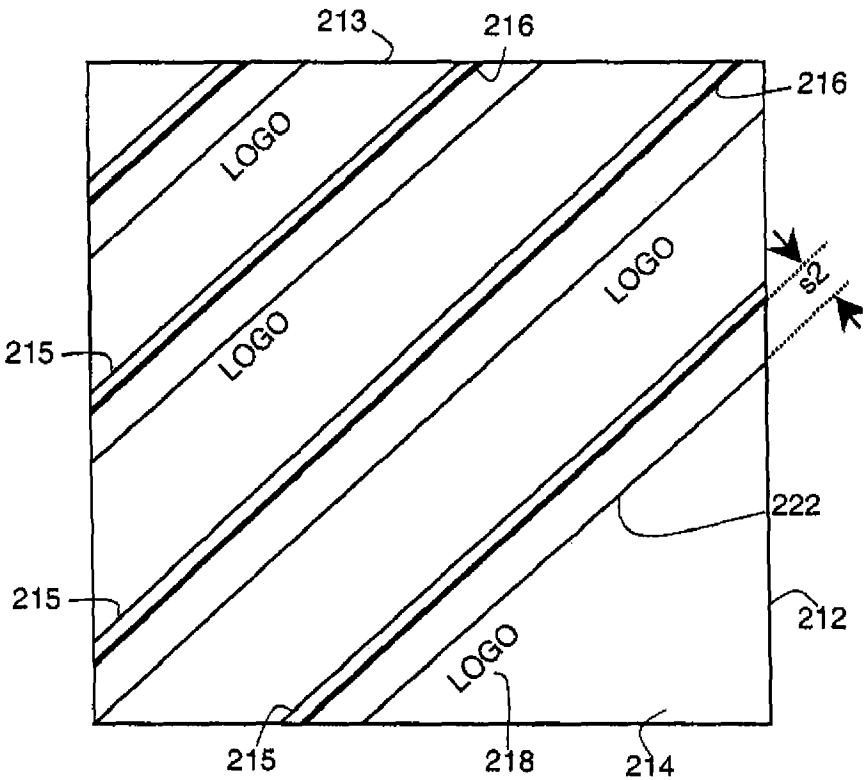
FIGS. 6*a* and 6*b* show schematic representation of markings on the backside of a first type of recording medium and a second type of recording medium respectively.
Figure 6A:
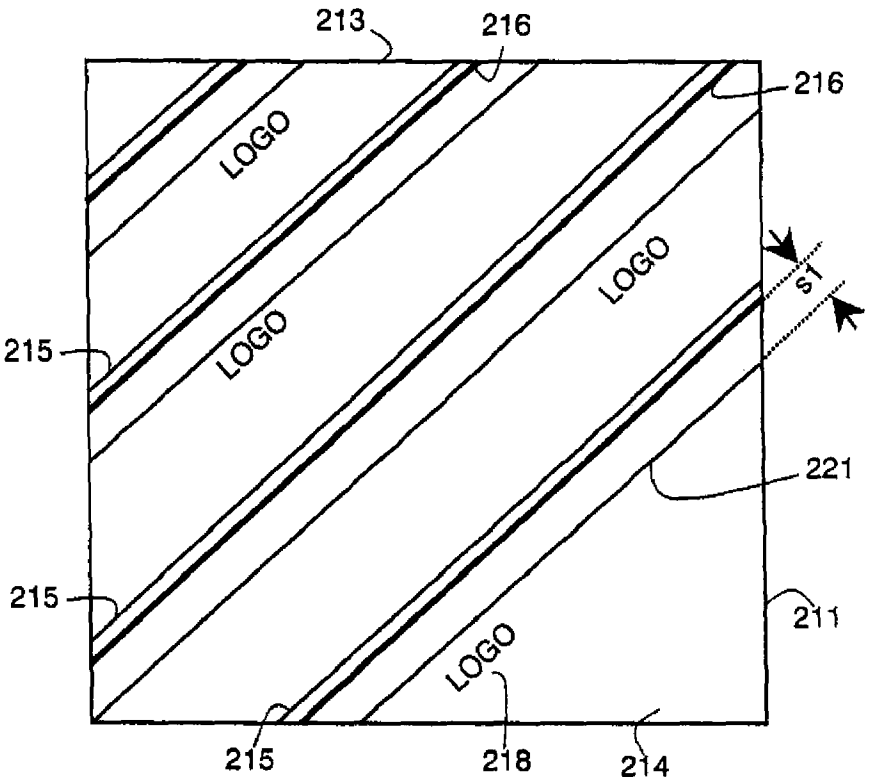

FIGS. 6*a* and 6*b* show schematic representation of markings on the backside of a first type of recording medium and a second type of recording medium respectively. In this embodiment, each of the various types of recording media has a reference marking consisting of a pair of "anchor bars" 215 and 216 which are located at a fixed distance with respect to one another for all media types. In addition, there is a first identification mark 221 on the first media type 211 in FIG. 6*a*, and there is an second identification mark 222 on the second media type 212 in FIG. 6*b*. In this example, first identification mark 221 is spaced a distance s1 away from anchor bar 216 on first media type 211, and second identification mark 222 is spaced a distance s2 away from anchor bar 216 on second media type 212, such that s1 does not equal s2. Thus in this example, it is the spacing of the identification mark from one of the anchor bars that identifies the particular type of recording medium. In other embodiments, rather than having the spacing between the identification mark and one of the anchor bars vary for different media types, one can have the width of the identification mark or the number of the identification marks vary for different media types. Other sorts of configurations of identification marks can be used to vary in order to identify different types of media. In general, in this invention a relationship between an identification mark and a reference mark is indicative of different types of recording media.

As shown in FIGS. 6*a* and 6*b*, recording media 211 and 212 each have a first end 213 and a second end 214. Recording media can be loaded by the user into the printer with either first end 213 or second end 214 as the lead edge of the recording medium and it is required that the printer be able to recognize the media type for either orientation of the recording medium. In order to enable recognition of media type regardless of media orientation, it is useful to design the anchor bar pair such that it is asymmetric relative to the media orientation. In the embodiment shown in FIGS. 6*a* and 6*b*, second anchor bar 216 is wider or optically more dense than first anchor bar 215, so that the sensor signal corresponding to second anchor bar 216 will have a higher peak amplitude, and/or a wider peak width (or in general, a different optical characteristic) than the sensor signal corresponding to first anchor bar 215. If the media type is identified by the spacing (e.g. s1 or s2) between the second anchor bar 216 and the identification mark (221 or 222 respectively), then the task in a first embodiment becomes: 1) identify an anchor bar pair 215 and 216 and their relative orientation on the basis of the photosensor signal; 2) determine the position of anchor bar 216; 3) identify a peak relative to the anchor bar pair (for example, corresponding to FIGS. 6*a* and 6*b*, identify the closest peak to the peak corresponding to second anchor bar 216, such that this closest peak is on the opposite side of the second anchor bar peak than is the peak corresponding to the first anchor bar 215); 4) determine the distance between the identified closest peak and the peak corresponding to the second anchor bar 216; and 5) identify the media type by relating the spacing (e.g. through a look-up table in the printer) to the media type.

Although the 5-step method described above can work satisfactorily in some cases, in other cases media type is incorrectly identified. An important source of unreliability is the identification of the anchor bar pair (step 1). Providing a reliable identification of the anchor bar pair and its location is a key feature of the present invention.

A first source of unreliability in the identification of the anchor bar pair is the random cutting position of the media, resulting in an unpredictable location of the first set of anchor bars on the media. Media is manufactured in long, wide rolls and then cut to size. A convenient configuration of anchor bars and identification marks is a series of long lines of different width or density that are provided periodically across the roll of media. Then when the media is cut, each sheet of media will include a plurality of anchor bars and their corresponding identification marks, with each set of anchor bars and identification marks periodically spaced across the sheet of media as shown in FIGS. 6*a* and 6*b*. In the examples of FIGS. 6*a* and 6*b*, the sheet of first recording media type 211 in FIG. 6*a* has been cut with the same relationship of cutting position to bars as the sheet of second recording media type 212 in FIG. 6*b*, but this is not generally the case.

A second source of unreliability in the identification of the anchor bar pair by peak-to-peak distance is media slip during advance of the media past the photosensor. In typical carriage printers, a rotary encoder is provided in association with one of the media advance rollers, such as feed roller 312. The amount of rotation θ of the encoder (and its associated roller) is monitored and is related to the nominal distance of media advance by Rθ, where R is the radius of the associated roller plus the media thickness. However, this nominal distance of media advance will be in error if the media slips relative to the roller during media advance, and/or if the wrong thickness of media is assumed. Although, as seen in FIGS. 6*a* and 6*b* there may be a plurality of anchor bar pairs and their associated identification marks on a given sheet of media, typically it is not practical to average the results over a plurality of anchor bar pairs and their associated identification marks due to media slippage, as well as the additional time required.

A third source of unreliability in the identification of the anchor bar pair by peak-to-peak distance is paper skew. The distance between peaks in the photosensor signal will depend upon the orientation of the anchor bars and identification mark relative to the media advance direction.

A fourth source of unreliability in the identification of the anchor bar pair is photosensor signals corresponding to the logo 218. Depending on how the media has been cut and the position of the media relative to the photosensor, the logo 218 may or may not pass within the field of view of the photosensor. Signals corresponding to a portion of the logo 218 and the information mark 221, for example, can be mistakenly identified as corresponding to an anchor bar pair if only peak-to-peak distance is used to identify the anchor bar pair.

A fifth source of unreliability in the identification of the anchor bar pair and precise determination of the position of the various peaks is noise in the photosensor signal. Noise in the photosensor signal can arise, for example, due to stray light impinging on the photosensor. Noise in the signal can also arise from mechanical vibrations between the sensor and the media.

In some embodiments, backside media sensor 375 is mounted on a pick arm (not shown) that houses the pick roller 320. In such embodiments, a sixth source of unreliability is an up and down motion of the pick arm (and hence the backside media sensor 375) as the media is being pulled forward. This up and down motion can cause an error in the measured distance between peaks.

As a sheet of media is picked (e.g. by pick roller 320) and advanced past backside media sensor 375 at a substantially uniform speed, a different amount of light is reflected into the photosensor of media sensor 375 from the backside media surface than is reflected from the anchor bars and identification marks. As a result, a time-varying signal is provided by the backside media sensor 375. A photosensor signal is larger when more light is received. For the case where the anchor bars and identification marks absorb light to a greater extent than the backside media surface, when the backside surface of the media is in the field of view (without other markings) the photosensor signal will be approximately at a high background level. When anchor bars, identification marks, logos, or other markings enter the field of view of the photosensor, the photosensor signal decreases. When a mark is fully in the field of view of the photosensor, the photosensor signal is at a relative low point. However, for some types of electronic processing of the signal, the signal is inverted and the low points become peaks. Herein, the position at which a marking is centrally located within the field of view of the photosensor will be called a peak, even though the photosensor signal itself will be at a low point.

Figure 7:
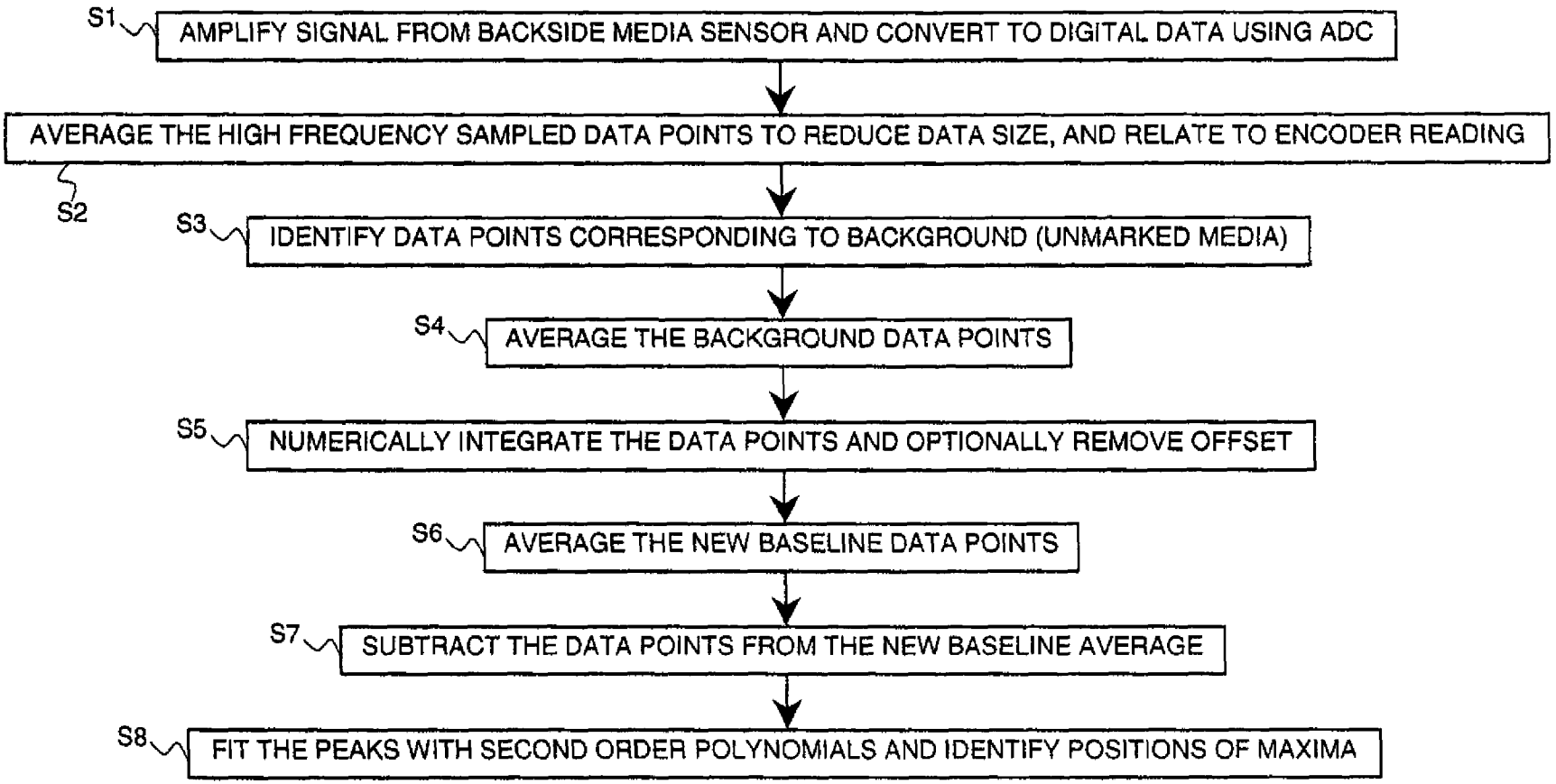
FIG. 7 is a flow diagram of an embodiment of the invention including a series of analog and digital signal processing steps for the photosensor signal.

The output signal from photosensor 377, corresponding to diffuse reflections of light from the manufacturer's marking, is relatively weak relative to background noise. Both analog circuitry and subsequent digital data processing can be used to enhance the signal relative to the background noise, as outlined in the flow diagram of FIG. 7. In one embodiment, an AC coupled amplifier having a first stage with a gain that increases at low frequencies and decreases at high frequencies, and a second stage with a gain greater than 5× is used. The gain of the first stage is designed to remove a DC offset and decrease background noise but let the signal through for frequencies f in a range that correspond to $v/d1<f<v/d2$, where d1 and d2 correspond to different spacings of manufacturer's markings that can appear on the backside of the media. In one embodiment, the AC amplifier is configured to provide a time derivative of the time varying signal in the frequency range of interest where the gain is increasing with frequency. If the photosensor signal decreases and then increases as a light absorbent marking enters and leaves the field of view, the time derivative of such a signal will first be negative and then will be positive. (If the signal is also inverted by the amplifier, the time derivative signal corresponding to a marking passing through the field of view will first be positive and then will be negative.) Also in one embodiment, the voltage level of the amplified photosensor output signal is biased to correspond to the midrange of an analog to digital converter (ADC), so that the complete range of variation of the amplified signal may be represented within the range of a less expensive 8 bit rather than requiring a 10 bit or 12 bit ADC, for example.

Once the amplified photosensor signal has been digitized in the ADC (step S1 of FIG. 7), digital signal processing can be used to further enhance the signal relative to high frequency background noise. In addition, the time-varying signal needs to be converted into spatial distances to find peak widths or distances between peaks corresponding to the manufacturer's markings. A rotary encoder coupled to one of the media feed rollers is used to track media position in the printer. In one example, the rotary encoder and feed roller diameter were configured such that 8402 encoder counts corresponded to one inch of media travel (i.e. about 331 encoder counts per mm).

Figure 8:
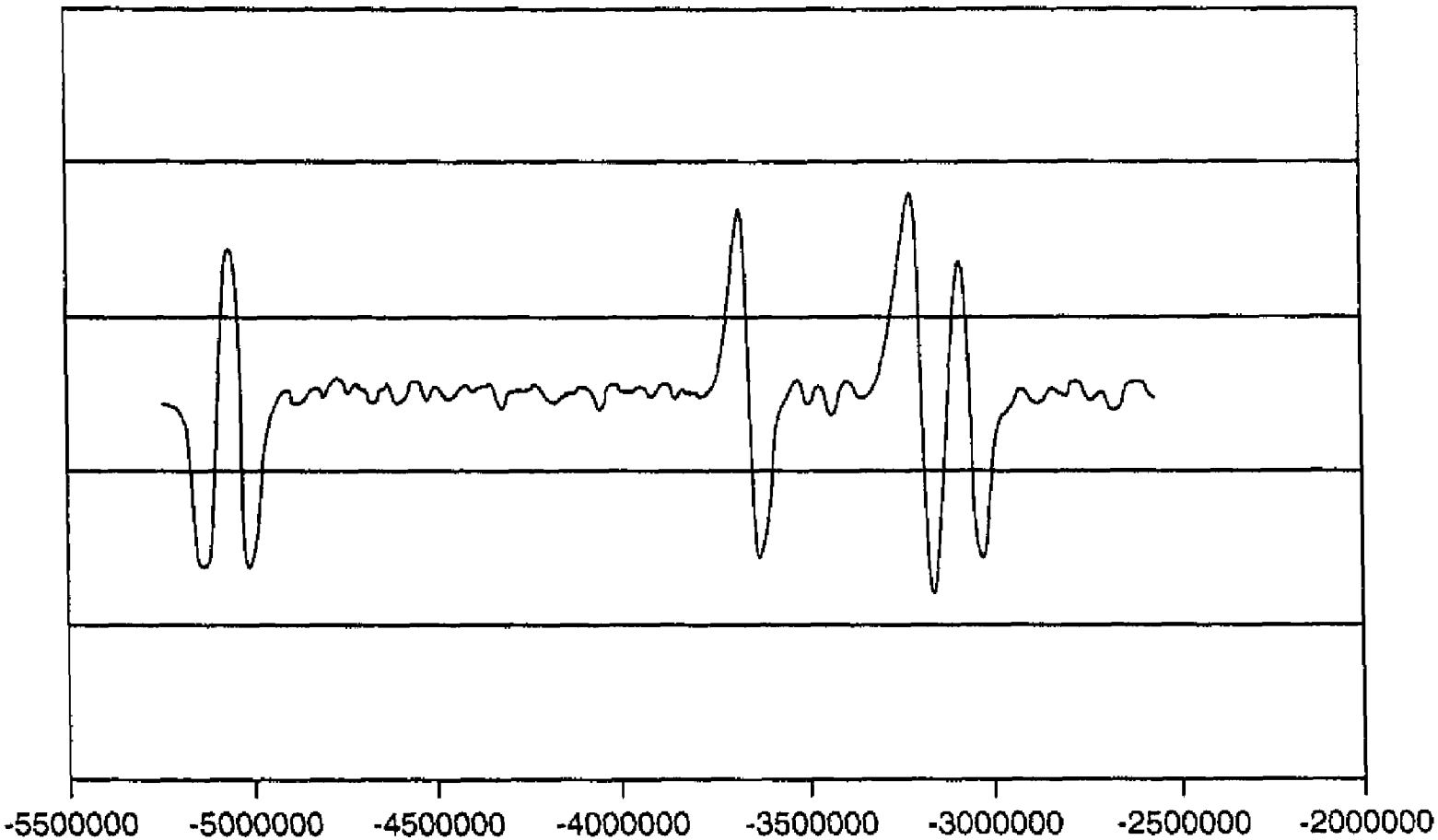
FIG. 8 is a plot of averaged digital data corresponding to a step in the signal processing of the photosensor signal.

One way to remove high frequency background noise and improve accuracy is to sample (or supersample) the ADC at a frequency that is significantly higher than the frequency of encoder counts. Several successive data points are then averaged and stored at a magnification of 100× so that the precision of the averaging is preserved. Because the signal of interest from the alignment pattern is varying comparably slowly, a fewer number of data points may be stored than the number in the sampled data set, but higher precision per data point is desired than in the original data set. The stored and averaged data points are also made to relate to the encoder readings (step S2 of FIG. 7). FIG. 8 shows an example a plot of the averaged data. There is still background noise, as is evident in the baseline between the peaks.

At step S3 data points corresponding to the high background level (or baseline) and representing unmarked media surface are identified as baseline data points. At step S4, the baseline data points are averaged to provide a baseline average.

Figure 9:
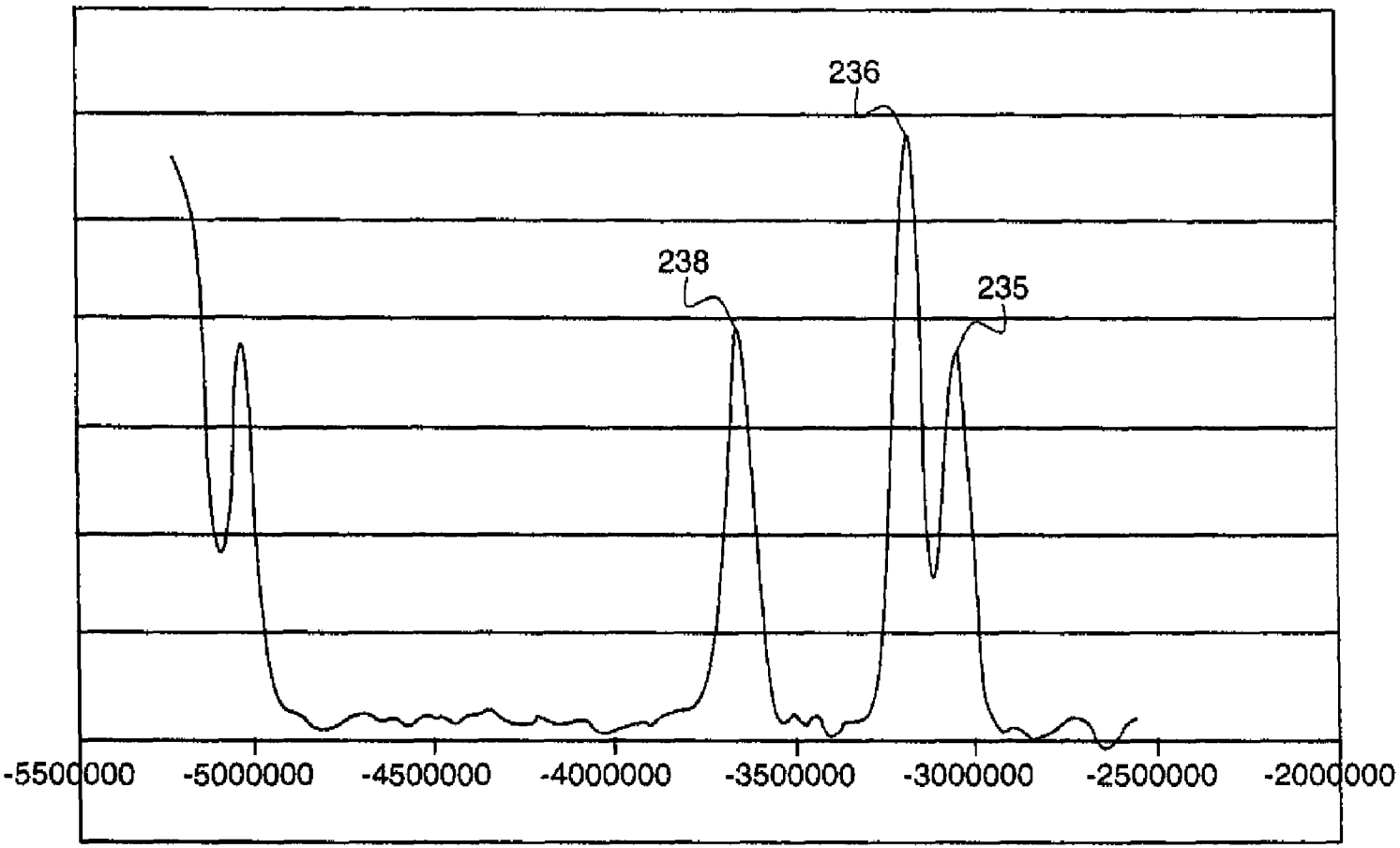
FIG. 9 is a plot of averaged digital data corresponding to another step in the signal processing of the photosensor signal.
Figure 10:
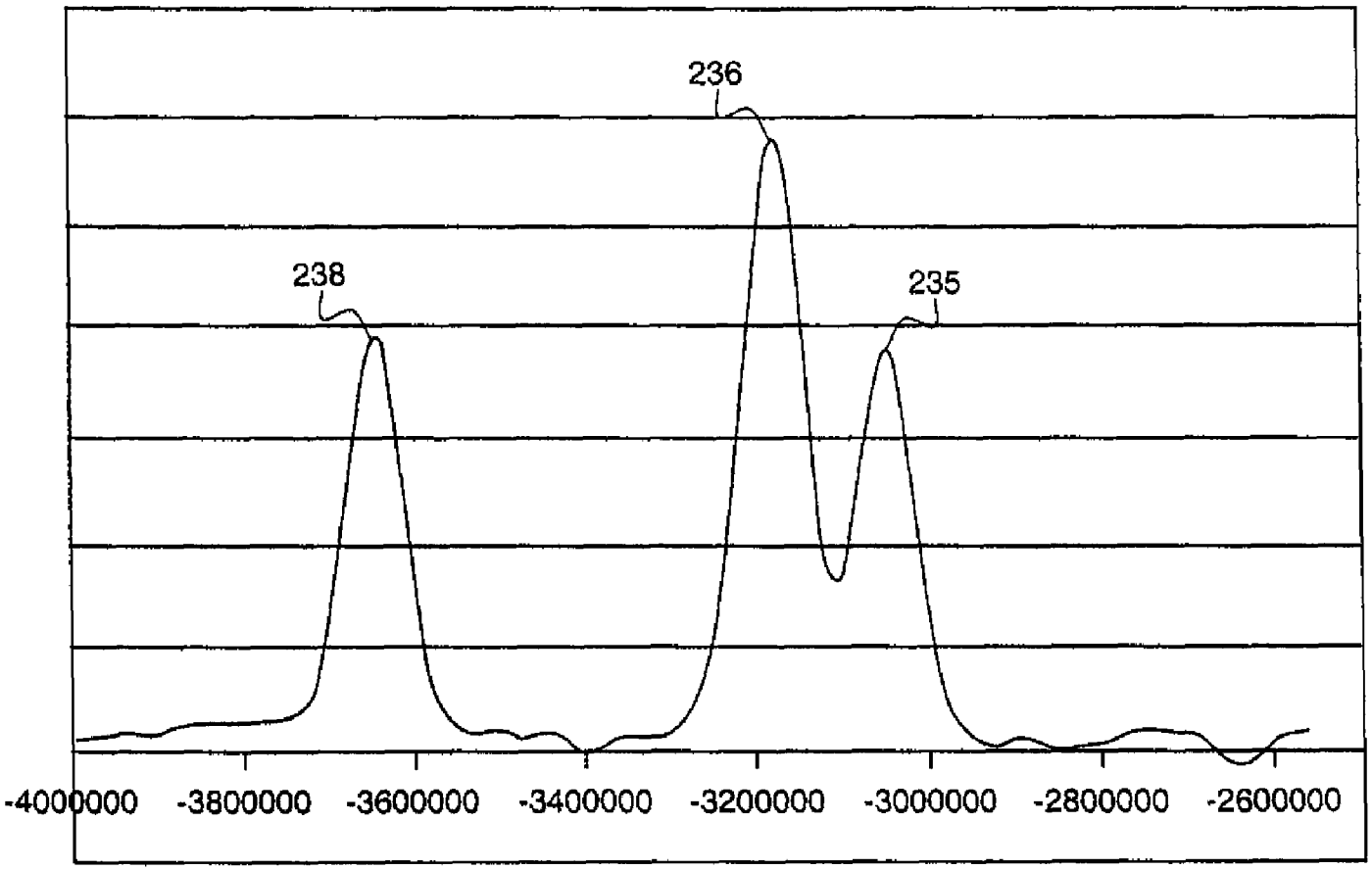
FIG. 10 is a plot of a portion of the photosensor signal corresponding to two reference marks and an identification mark.

Next at step S5 the data is numerically integrated and the baseline average is subtracted during integration. Integration of the data helps to remove some of the noise from the signal. Subtraction of the baseline average during the integration prevents integrated constant background from resulting in data that increases over time. Following the integration step S5, the new baseline data points are averaged in step S6 to provide a new baseline average. In step S7, the data points are subtracted from the new baseline average. The output of step S7 is a series of peaks relative to a zero level. A portion of data after step S7 is illustrated in FIG. 9. From right to left, the data curve in FIG. 9 includes a peak 235 possibly corresponding to the first anchor bar 215, a taller peak 236 possibly corresponding to the wider/denser second anchor bar 216, a possible identification mark peak 238, and additional unnumbered peaks further to the left. (The region of peaks 235, 236 and 238 is shown at higher magnification in FIG. 10.) However, at this stage, the possible correspondences have not been established.

Figure 11:
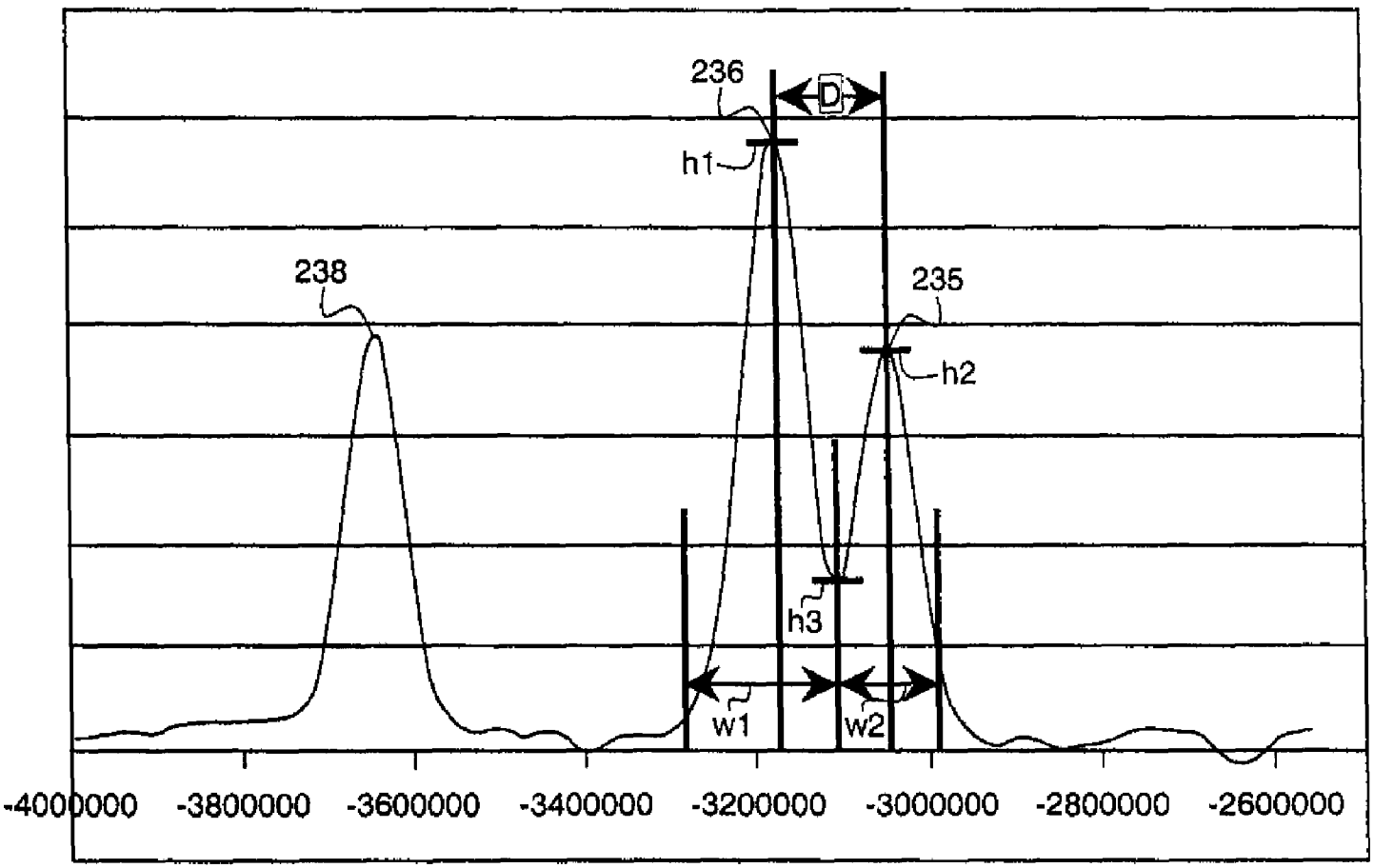
FIG. 11 shows measurements that are made on the reference peaks of FIG. 10, according to an aspect of the present invention.

An inventive step in the present invention is to not simply rely upon distances between peaks to identify the peaks corresponding to the anchor bars 215 and 216, but rather upon a combination of peak heights, peak widths and a peak to peak distance. Optionally at step S8, the data points near the peaks are fit with second order polynomials. Then as illustrated in FIG. 11 the following parameters are determined: the height h1 of peak 236; the height h2 of adjacent peak 235, the height of valley h3 between peaks 235 and 236; the width w1 of peak 236, the width w2 of peak 236, and the distance D between peaks 235 and 236. Because peaks 235 and 236 are partially overlapping, a convention must be established as to where the widths will be measured. In the example shown in FIG. 11, the width of peak 236 was measured from a point that is 15% of the height of peak 236 to the point at the valley between peaks 235 and 236. Also in this example, the width of peak 235 was measured from the point at the valley between peaks 235 and 236 to a point on the peak 235 side of the valley that is 15% of the height of peak 236.

Peaks corresponding to anchor bars on many different sheets of media from a particular media supplier were measured in several different printer units. Table 1 shows ranges for these values (or ranges for ratios of values) corresponding to anchor bar pairs. Of course, for a different photosensor field of view, or a different design of anchor bar pairs, the values would be outside these ranges. Anchor bar pairs are identified as having being two adjacent peaks that have parameter values that fit within the ranges described in Table 1 in this example.

TABLE 1

| PARAMETER | VALUE |
|---|---|
| Ratio of heights h2/h1 | $0.3 < h2/h1 < 0.8$ |
| Ratio of heights h3/h1 | $0.15 < h3/h1 < 0.45$ |
| Ratio of heights h3/h2 | $h3/h2 < 0.75$ |
| Peak to peak distance D | $2.5\ mm < D < 5.0\ mm$ |
| Peak width ratio w2/w1 | $0.5 < w2/w1 < 1$ |

Figure 12:
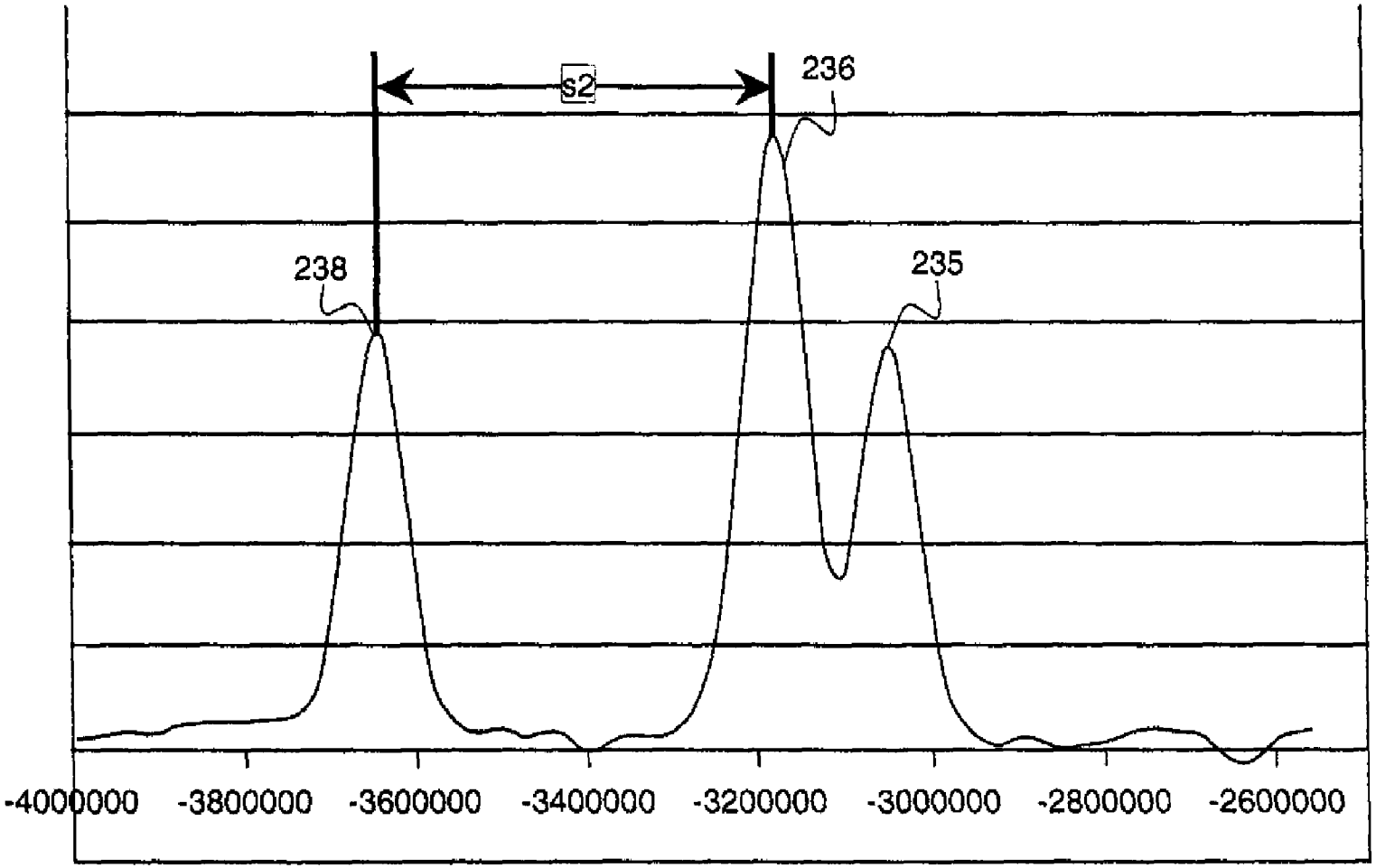
FIG. 12 shows the measurement between a reference peak and an identification peak, according to an example of the present invention.

After the anchor bar pair has been identified, as described above, the distance may be determined between the signal for a portion of the anchor bar pair (for example the position of peak 236) and the signal for an adjacent peak 238. In FIG. 12, the distance is measured to be s2, which identifies the type of media as the second type of recording medium 212. A look-up table relating media types to distances between anchor bars and identification marks may be provided in the printer.

Figure 13:
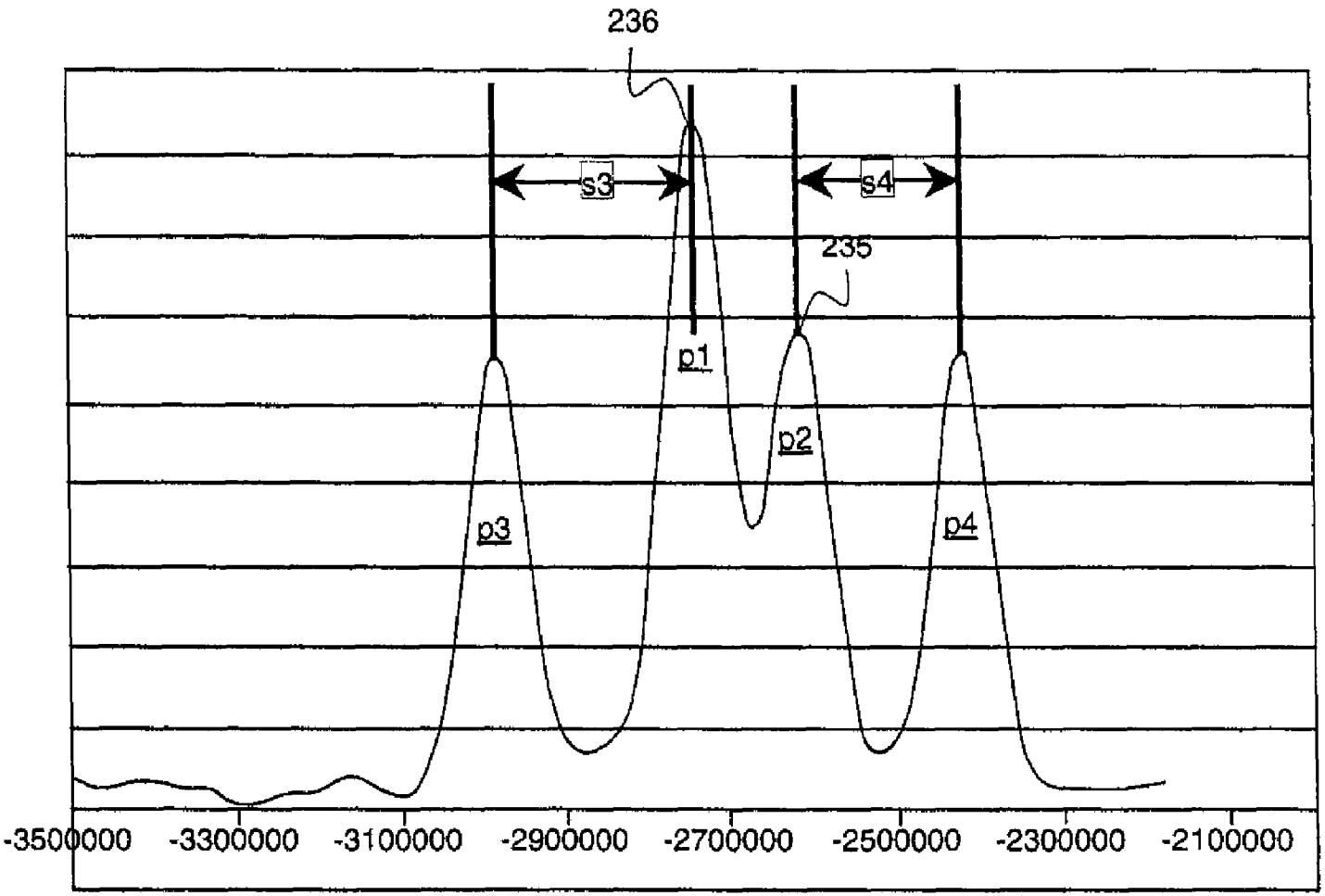
FIG. 13 shows measurements between a first reference peak and a first identification peak, and also between a second reference peak and a second identification peak, according to an example of the present invention.

FIG. 13 shows the photosensor signal peaks corresponding to an example of a configuration of anchor bars 235 and 236 and identification marking including two identification bars (corresponding to peaks p3 and p4) with the anchor bars (corresponding to p1 and p2) between the two identification bars. In such an example, it can be advantageous for bar distance accuracy to measure peak-to-peak distance between adjacent peaks, rather than measuring the peak-to-peak distance from a particular portion of the anchor bars (e.g. peak 236 or p1) to each of the identification bars. In the example of FIG. 13, what is measured is the peak-to-peak distance s3 between reference peak p1 (236) and adjacent identification peak p3, and peak-to-peak distance s4 between reference peak p2 (235) and adjacent identification peak p4.

The invention has been described in detail with particular reference to certain preferred embodiments thereof, but it will be understood that variations and modifications can be effected within the scope of the invention.

PARTS LIST

10 Inkjet printer system
12 Image data source
14 Controller
16 Electrical pulse source
18 First fluid source
19 Second fluid source
20 Recording medium
100 Ink jet printhead
110 Ink jet printhead die
111 Substrate
120 First nozzle array
121 Nozzle in first nozzle array
122 Ink delivery pathway for first nozzle array
130 Second nozzle array
131 Nozzle in second nozzle array
132 Ink delivery pathway for second nozzle array
181 Droplet ejected from first nozzle array
182 Droplet ejected from second nozzle array
200 Carriage
211 First type recording medium
212 Second type recording medium
213 First end of the recording medium
214 Second end of the recording medium
215 First bar of anchor bar pair
216 Second bar of anchor bar pair
218 Logo
221 Identification mark for first type recording medium
222 Identification mark for second type recording medium
235 Data peak corresponding to first anchor bar
236 Data peak corresponding to second anchor bar
238 Data peak corresponding to identification mark
250 Printhead chassis
251 Printhead die
253 Nozzle array
254 Nozzle array direction
256 Encapsulant
257 Flex circuit
258 Connector board
262 Multichamber ink supply
264 Single chamber ink supply
300 Printer chassis
302 Paper load entry
303 Print region
304 Paper exit
306 Right side of printer chassis
307 Left side of printer chassis
308 Front of printer chassis
309 Rear of printer chassis
310 Hole for paper advance motor drive gear
311 Feed roller gear
312 Feed roller
313 Forward rotation of feed roller
319 Feed roller shaft
320 Pickup roller
322 Turn roller
323 Idler roller
324 Discharge roller
325 Star wheel
330 Maintenance station
370 Stack of media

371 Top sheet
372 Main paper tray
373 Photo paper stack
374 Photo paper tray
375 Backside media sensor
380 Carriage motor
382 Carriage rail
384 Belt
390 Printer electronics board
392 Cable connectors

The invention claimed is:

1. A method of identifying a type of recording medium, the recording medium comprising information marks including a reference mark and an identification mark, a relationship of the identification mark and the reference mark being indicative of the type of recording medium, the method comprising:

moving the recording medium relative to a sensor at a substantially uniform speed;

processing a signal from the sensor to provide digitized data of the signal;

identifying a plurality of peaks in the digitized data;

determining at least one of the heights and widths of each of the plurality of peaks;

determining a peak to peak distance between two adjacent peaks of the plurality of peaks;

identifying a peak corresponding to the reference mark using a ratio of peak heights of the adjacent peaks;

determining a configuration of a peak corresponding to the identification mark by locating a peak that is spaced apart from the position of the peak corresponding to the reference mark; and identifying the type of recording medium using the configuration of the peak corresponding to the identification mark.

2. The method according to claim 1, wherein the reference mark includes a first mark and a second mark, the second mark having a different characteristic when compared to the first mark.

3. The method according to claim 1, wherein identifying the type of recording medium according to the configuration of the peak corresponding to the identification mark comprises:

determining a spacing between the peak corresponding to the identification mark and the peak corresponding to the reference mark; and using a look up table and the spacing to identify the corresponding media type.

4. The method according to claim 1, wherein processing the signal from the sensor to provide digitized data of the signal comprises:

amplifying the signal;

converting the amplified signal to digitized data using an analog to digital converter; and numerically integrating the digital data.

5. The method according to claim 1, wherein identifying the plurality of peaks in the digitized data comprises fitting each peak of the plurality of peaks with a second order polynomial.

6. The method according to claim 1, wherein identifying the peak corresponding to the reference mark includes using a ratio of peak widths of the adjacent peaks.

7. The method according to claim 1, wherein identifying the peak corresponding to the reference mark further includes using a ratio of a peak height to a height of a valley between the adjacent peaks.

8. The method according to claim 1, wherein the sensor is an optical sensor.

9. The method according to claim 1, wherein identifying the peak corresponding to the reference mark includes using a ratio of a peak height to a height of a valley between the adjacent peaks.

10. A method of identifying a type of recording medium, the recording medium comprising information marks including a reference mark and an identification mark, a relationship of the identification mark and the reference mark being indicative of the type of recording medium, the method comprising:

moving the recording medium relative to a sensor at a substantially uniform speed;

processing a signal from the sensor to provide digitized data of the signal;

identifying a plurality of peaks in the digitized data;

determining at least one of the heights and widths of each of the plurality of peaks;

determining a peak to peak distance between two adjacent peaks of the plurality of peaks;

identifying a peak corresponding to the reference mark using a ratio of peak heights of adjacent peaks;

determining a configuration of a peak corresponding to the identification mark by locating a peak that is spaced apart from the position of the peak corresponding to the reference mark;

identifying the type of recording medium using the configuration of the peak corresponding to the identification mark; and wherein the reference mark includes a first peak and a second peak, the second peak includes a different characteristic when compared to the first peak, the identification mark includes a third peak and a fourth peak, and wherein identifying the type of recording medium according to the configuration of the peak corresponding to the identification mark comprises:

determining a first spacing between the third peak corresponding to the identification mark and the first peak corresponding to the reference mark;

determining a second spacing between the fourth peak corresponding to the identification mark and the second peak corresponding to the reference mark; and using a look up table, the first spacing, and the second spacing to identify the corresponding media type.

* * * * *